US008180475B2

(12) United States Patent
Taguchi et al.

(10) Patent No.: US 8,180,475 B2
(45) Date of Patent: May 15, 2012

(54) EMBROIDERY DATA PROCESSOR, EMBROIDERY SEWING SYSTEM, COMPUTER READABLE MEDIUM AND MULTI-NEEDLE EMBROIDERY SEWING MACHINE

(75) Inventors: Shoichi Taguchi, Nagoya (JP); Motoshi Kishi, Nagoya (JP); Hiroyuki Suzuki, Nagoya (JP); Masayuki Iwata, Gifu (JP); Yoshio Sugiura, Nishikamo-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 970 days.

(21) Appl. No.: 12/219,295

(22) Filed: Jul. 18, 2008

(65) Prior Publication Data

US 2009/0020054 A1 Jan. 22, 2009

(30) Foreign Application Priority Data

Jul. 18, 2007 (JP) ..... 2007-186572

(51) Int. Cl.
*D05C 5/02* (2006.01)

(52) U.S. Cl. .... 700/138; 112/103; 112/155; 112/470.01

(58) Field of Classification Search ..... 112/102.5, 112/103, 155, 470.01, 470.02, 470.06, 475.19; 700/136–138
See application file for complete search history.

(56) References Cited

U.S. PATENT DOCUMENTS

| | | | | |
|---|---|---|---|---|
| 4,369,722 | A | 1/1983 | Nishida et al. | |
| 4,932,342 | A | 6/1990 | Hisatake et al. | |
| 5,392,724 | A | 2/1995 | Kurono et al. | |
| 5,701,830 | A * | 12/1997 | Muto | 112/102.5 |
| 5,727,485 | A | 3/1998 | Morita | |
| 5,740,748 | A * | 4/1998 | Morita | 112/102.5 |
| 5,904,109 | A * | 5/1999 | Asano | 112/102.5 |
| 5,974,992 | A | 11/1999 | Asano | |
| 6,012,402 | A * | 1/2000 | Sekine | 112/102.5 |
| 6,631,306 | B2 | 10/2003 | Funahashi et al. | |
| 6,708,076 | B2 | 3/2004 | Zhang et al. | |
| 6,983,192 | B2 * | 1/2006 | Block et al. | 700/138 |
| 7,983,781 | B2 * | 7/2011 | Hayakawa | 700/136 |
| 2002/0013745 | A1 | 1/2002 | Funahashi et al. | |

FOREIGN PATENT DOCUMENTS

| | | |
|---|---|---|
| JP | A-56-123448 | 9/1981 |
| JP | A-59-082891 | 5/1984 |
| JP | A-02-060688 | 3/1990 |
| JP | A-02-216254 | 8/1990 |
| JP | A-06-304372 | 11/1994 |
| JP | A-07-194880 | 8/1995 |
| JP | A-09-111638 | 4/1997 |

(Continued)

*Primary Examiner* — Nathan Durham
(74) *Attorney, Agent, or Firm* — Oliff & Berridge, PLC

(57) ABSTRACT

An embroidery data processor that processes embroidery data for sewing an embroidery pattern comprising a plurality of subset patterns on a workpiece cloth with different needle thread colors by using a plurality of multi-needle embroidery sewing machines each provided with an embroidery frame drive mechanism that moves an embroidery frame holding the workpiece cloth in two predetermined directions, the embroidery data processor including a sew-time calculator that calculates required sew time for sewing each subset pattern based on subset pattern data being classified by thread color; and an allocator that produces an allocation schedule for allocation of the subset patterns to the multi-needle embroidery sewing machines based on the sew time calculated by the sew-time calculator, the allocation schedule being arranged to distribute equal or minimally-different sew time for each multi-needle embroidery sewing machine.

17 Claims, 23 Drawing Sheets

FOREIGN PATENT DOCUMENTS

| | | |
|---|---|---|
| JP | A-11-253676 | 9/1999 |
| JP | A-2001-170383 | 6/2001 |
| JP | A-2001-170384 | 6/2001 |
| JP | A-2001-334086 | 12/2001 |
| JP | A-2003-053077 | 2/2003 |

* cited by examiner

[FIRST SEWING MACHINE]

| NEEDLE BAR NUMBER | NEEDLE-THREAD COLOR NUMBER |
|---|---|
| NEEDLE BAR 1 | THREAD COLOR 1 |
| NEEDLE BAR 2 | THREAD COLOR 2 |
| NEEDLE BAR 3 | THREAD COLOR 3 |
| NEEDLE BAR 4 | THREAD COLOR 4 |
| NEEDLE BAR 5 | THREAD COLOR 5 |
| NEEDLE BAR 6 | THREAD COLOR 6 |

FIG. 3

[SECOND SEWING MACHINE]

| NEEDLE BAR NUMBER | NEEDLE-THREAD COLOR NUMBER |
|---|---|
| NEEDLE BAR 1 | THREAD COLOR 5 |
| NEEDLE BAR 2 | THREAD COLOR 6 |
| NEEDLE BAR 3 | THREAD COLOR 7 |
| NEEDLE BAR 4 | THREAD COLOR 8 |
| NEEDLE BAR 5 | THREAD COLOR 9 |
| NEEDLE BAR 6 | THREAD COLOR 10 |

FIG. 4

FIG.5

| |
|---|
| FIG.5A |
| FIG.5B |

| EMBROIDERY DATA | |
|---|---|
| FIRST SUBSET PATTERN DATA | THREAD COLOR 1 |
| | FEED DATA(Fxa,Fya) • • • <START POSITION> |
| | (x1,y1) • • <FIRST STITCH NEEDLE-DROP POSITION> |
| | (x2,y2) • • <SECOND STITCH NEEDLE-DROP POSITION> |
| | (x3,y3) • • <THIRD STITCH NEEDLE-DROP POSITION> |
| | • • |
| | • • |
| | (xn,yn) • • <nTH STITCH NEEDLE-DROP POSITION> |
| | STOP CODE |
| SECOND SUBSET PATTERN DATA | THREAD COLOR 2 |
| | FEED DATA(Fxb,Fyb) • • • <START POSITION> |
| | (x1,y1) • • <FIRST STITCH NEEDLE-DROP POSITION> |
| | (x2,y2) • • <SECOND STITCH NEEDLE-DROP POSITION> |
| | (x3,y3) • • <THIRD STITCH NEEDLE-DROP POSITION> |
| | • • |
| | • • |
| | (xn,yn) • • <nTH STITCH NEEDLE-DROP POSITION> |
| | STOP CODE |
| THIRD SUBSET PATTERN DATA | THREAD COLOR 3 |
| | FEED DATA(Fxc,Fyc) • • • <START POSITION> |

FIG.5A

| | |
|---|---|
| NINTH SUBSET PATTERN DATA | • • |
| | • • |
| | • • |
| | • • |
| | • • |
| | • • |
| | (xn,yn) • • <nTH STITCH NEEDLE-DROP POSITION> |
| | STOP CODE |
| TENTH SUBSET PATTERN DATA | THREAD COLOR 10 |
| | FEED DATA(Fxj,Fyj) • • • <START POSITION> |
| | (x1,y1) • • <FIRST STITCH NEEDLE-DROP POSITION> |
| | (x2,y2) • • <SECOND STITCH NEEDLE-DROP POSITION> |
| | (x3,y3) • • <THIRD STITCH NEEDLE-DROP POSITION> |
| | • • |
| | • • |
| | • • |
| | • • |
| | (xn,yn) • • <nTH STITCH NEEDLE-DROP POSITION> |
| | END CODE |

FIG.5B

[COMBINATION CALCULATION CONTROL OF SUBSET PATTERN]

[SUBSET PATTERN DATA CALCULATION PROCESS]

FIG.9

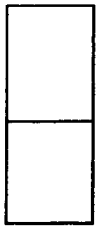

FIG.9A

| SEWING MACHINE | EMBROIDERY DATA | SEW TIME |
|---|---|---|
| M1 | THREAD COLOR 1 | 2 MINUTES |
| | FD(Fxa,Fya) | |
| | FIRST SUBSET PATTERN DATA | |
| | STOP CODE | |
| M1 | THREAD COLOR 2 | 3 MINUTES |
| | FD(Fxb,Fyb) | |
| | SECOND SUBSET PATTERN DATA | |
| | STOP CODE | |
| M1 | THREAD COLOR 3 | 3 MINUTES |
| | FD(Fxc,Fyc) | |
| | THIRD SUBSET PATTERN DATA | |
| | STOP CODE | |
| M1 | THREAD COLOR 4 | 2 MINUTES |
| | FD(Fxd,Fyd) | |
| | FOURTH SUBSET PATTERN DATA | |
| | STOP CODE | |
| M | THREAD COLOR 5 | 1 MINUTE |
| | FD(Fxe,Fye) | |
| | FIFTH SUBSET PATTERN DATA | |
| | STOP CODE | |

| | | |
|---|---|---|
| M | THREAD COLOR 6 | 5 MINUTES |
| | FD(Fxf,Fyf) | |
| | SIXTH SUBSET PATTERN DATA | |
| | STOP CODE | |
| M2 | THREAD COLOR 7 | 3 MINUTES |
| | FD(Fxg,Fyg) | |
| | SEVENTH SUBSET PATTERN DATA | |
| | STOP CODE | |
| M2 | THREAD COLOR 8 | 4 MINUTES |
| | FD(Fxh,Fyh) | |
| | EIGHTH SUBSET PATTERN DATA | |
| | STOP CODE | |
| M2 | THREAD COLOR 9 | 4 MINUTES |
| | FD(Fxi,Fyi) | |
| | NINTH SUBSET PATTERN DATA | |
| | STOP CODE | |
| M2 | THREAD COLOR 10 | 3 MINUTES |
| | FD(Fxj,Fyj) | |
| | TENTH SUBSET PATTERN DATA | |
| | END CODE | |

FIG. 9B

| COMBINATION NUMBER | SUBSET PATTERN NUMBER AND SEWING MACHINE NAME | SUBSET PATTERN NUMBER AND SEWING MACHINE NAME |
|---|---|---|
| 1 | SEW SUBSET PATTERN 5 BY CHILD MACHINE | SEW SUBSET PATTERN 6 BY CHILD MACHINE |
| 2 | SEW SUBSET PATTERN 5 BY PARENT MACHINE | SEW SUBSET PATTERN 6 BY CHILD MACHINE |
| 3 | SEW SUBSET PATTERN 5 BY CHILD MACHINE | SEW SUBSET PATTERN 6 BY PARENT MACHINE |
| 4 | SEW SUBSET PATTERN 5 BY PARENT MACHINE | SEW SUBSET PATTERN 6 BY PARENT MACHINE |

FIG.10

| COMBINATION NUMBER | SEW TIME OF PARENT MACHINE | SEW TIME OF CHILD MACHINE | DIFFERERNCE IN SEW TIME |
|---|---|---|---|
| 1 | 10 MINUTES | 20 MINUTES | 10 MINUTES |
| 2 | 11 MINUTES | 19 MINUTES | 8 MINUTES |
| 3 | 15 MINUTES | 15 MINUTES | 0 MINUTE |
| 4 | 16 MINUTES | 14 MINUTES | 2 MINUTES |

FIG.11

| SUBSET PATTERN NAME | END COORDINATE |
|---|---|
| SIXTH SUBSET PATTERN | X6E,Y6E |

FIG.12A

| SUBSET PATTERN NAME | END COORDINATE |
|---|---|
| FOURTH SUBSET PATTERN | X4E,Y4E |
| FIFTH SUBSET PATTERN | X5E,Y5E |
| SIXTH SUBSET PATTERN | X6E,Y6E |

FIG.12B

FIG.13

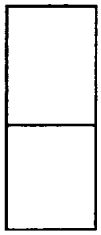

FIG.13A

| SEWING MACHINE | EMBROIDERY DATA | SEW TIME |
|---|---|---|
| M1 | THREAD COLOR 1 | 2 MINUTES |
| | FD(Fxa,Fya) | |
| | FIRST SUBSET PATTERN DATA | |
| | STOP CODE | |
| M1 | THREAD COLOR 2 | 3 MINUTES |
| | FD(Fxb,Fyb) | |
| | SECOND SUBSET PATTERN DATA | |
| | STOP CODE | |
| M1 | THREAD COLOR 3 | 3 MINUTES |
| | FD(Fxc,Fyc) | |
| | THIRD SUBSET PATTERN DATA | |
| | STOP CODE | |
| M1 | THREAD COLOR 4 | 2 MINUTES |
| | FD(Fxd,Fyd) | |
| | FOURTH SUBSET PATTERN DATA | |
| | STOP CODE | |
| M1 | THREAD COLOR 5 | 1 MINUTE |
| | FD(Fxe,Fye) | |
| | FIFTH SUBSET PATTERN DATA | |
| | STOP CODE | |
| | | |

| | | |
|---|---|---|
| M1 | THREAD COLOR 6 | 5 MINUTES |
| | FD(Fxf,Fyf) | |
| | SIXTH SUBSET PATTERN DATA | |
| | STOP CODE | |
| M2 | THREAD COLOR 7 | 3 MINUTES |
| | FD(Fxg,Fyg) | |
| | SEVENTH SUBSET PATTERN DATA | |
| | STOP CODE | |
| M2 | THREAD COLOR 8 | 4 MINUTES |
| | FD(Fxh,Fyh) | |
| | EIGHTH SUBSET PATTERN DATA | |
| | STOP CODE | |
| M2 | THREAD COLOR 9 | 4 MINUTES |
| | FD(Fxi,Fyi) | |
| | NINTH SUBSET PATTERN DATA | |
| | STOP CODE | |
| M2 | THREAD COLOR 10 | 3 MINUTES |
| | FD(Fxj,Fyj) | |
| | TENTH SUBSET PATTERN DATA | |
| | END CODE | |

FIG.13B

[EMBROIDERY DATA FOR FIRST SEWING MACHINE]

| EMBROIDERY DATA | SEW TIME |
|---|---|
| THREAD COLOR 1 | 2 MINUTES |
| FD(Fxa,Fya) | |
| FIRST SUBSET PATTERN DATA | |
| STOP CODE | |
| THREAD COLOR 2 | 3 MINUTES |
| FD(Fxb,Fyb) | |
| SECOND SUBSET PATTERN DATA | |
| STOP CODE | |
| THREAD COLOR 3 | 3 MINUTES |
| FD(Fxc,Fyc) | |
| THIRD SUBSET PATTERN DATA | |
| STOP CODE | |
| THREAD COLOR 4 | 2 MINUTES |
| FD(Fxd,Fyd) | |
| FOURTH SUBSET PATTERN DATA | |
| STOP CODE | |
| THREAD COLOR 5 | 1 MINUTE |
| FD(Fxe,Fye) | |
| FIFTH SUBSET PATTERN DATA | |
| STOP CODE | |
| THREAD COLOR 6 | 5 MINUTES |
| FD(Fxf,Fyf) | |
| SIXTH SUBSET PATTERN DATA | |
| END CODE | |

FIG.14A

[EMBROIDERY DATA FOR SECOND SEWING MACHINE]

| EMBROIDERY DATA | SEW TIME |
|---|---|
| THREAD COLOR 7 | 3 MINUTES |
| FD(Fx6E,Fy6E) | |
| FD(Fxg,Fyg) | |
| SEVENTH SUBSET PATTERN DATA | |
| STOP CODE | |
| THREAD COLOR 8 | 4 MINUTES |
| FD(Fxh,Fyh) | |
| EIGHTH SUBSET PATTERN DATA | |
| STOP CODE | |
| THREAD COLOR 9 | 4 MINUTES |
| FD(Fxi,Fyi) | |
| NINTH SUBSET PATTERN DATA | |
| STOP CODE | |
| THREAD COLOR 10 | 3 MINUTES |
| FD(Fxj,Fyj) | |
| TENTH SUBSET PATTERN DATA | |
| END CODE | |

FIG.14B

FIG.15

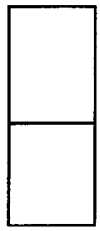

FIG.15A

| SEWING MACHINE | EMBROIDERY DATA | SEW TIME |
|---|---|---|
| M1 | THREAD COLOR 1 | 2 MINUTES |
| | FD(Fxa,Fya) | |
| | FIRST SUBSET PATTERN DATA | |
| | STOP CODE | |
| M1 | THREAD COLOR 2 | 3 MINUTES |
| | FD(Fxb,Fyb) | |
| | SECOND SUBSET PATTERN DATA | |
| | STOP CODE | |
| M1 | THREAD COLOR 3 | 3 MINUTES |
| | FD(Fxc,Fyc) | |
| | THREAD SUBSET PATTERN DATA | |
| | STOP CODE | |
| M1 | THREAD COLOR 4 | 2 MINUTES |
| | FD(Fxd,Fyd) | |
| | FOURTH SUBSET PATTERN DATA | |
| | STOP CODE | |
| M2 | THREAD COLOR 5 | 1 MINUTE |
| | FD(Fxe,Fye) | |
| | FIFTH SUBSET PATTERN DATA | |
| | STOP CODE | |
| | | |

| | | |
|---|---|---|
| M1 | THREAD COLOR 6 | 5 MINUTES |
| | FD(Fxf,Fyf) | |
| | SIXTH SUBSET PATTERN DATA | |
| | STOP CODE | |
| M2 | THREAD COLOR 7 | 3 MINUTES |
| | FD(Fxg,Fyg) | |
| | SEVENTH SUBSET PATTERN DATA | |
| | STOP CODE | |
| M2 | THREAD COLOR 8 | 4 MINUTES |
| | FD(Fxh,Fyh) | |
| | EIGHTH SUBSET PATTERN DATA | |
| | STOP CODE | |
| M2 | THREAD COLOR 9 | 4 MINUTES |
| | FD(Fxi,Fyi) | |
| | NINTH SUBSET PATTERN DATA | |
| | STOP CODE | |
| M2 | THREAD COLOR 10 | 3 MINUTES |
| | FD(Fxj,Fyj) | |
| | TENTH SUBSET PATTERN DATA | |
| | END CODE | |

FIG.15B

[EMBROIDERY DATA FOR FIRST SEWING MACHINE]

| EMBROIDERY DATA | SEW TIME |
|---|---|
| THREAD COLOR 1 | 2 MINUTES |
| FD(Fxa,Fya) | |
| FIRST SUBSET PATTERN DATA | |
| STOP CODE | |
| THREAD COLOR 2 | 3 MINUTES |
| FD(Fxb,Fyb) | |
| SECOND SUBSET PATTERN DATA | |
| STOP CODE | |
| THREAD COLOR 3 | 3 MINUTES |
| FD(Fxc,Fyc) | |
| THIRD SUBSET PATTERN DATA | |
| STOP CODE | |
| THREAD COLOR 4 | 2 MINUTES |
| FD(Fxd,Fyd) | |
| FOURTH SUBSET PATTERN DATA | |
| STOP CODE | |
| THREAD COLOR 6 | 5 MINUTES |
| FD(Fx4E5E,Fy4E5E) | |
| FD(Fxf,Fyf) | |
| SIXTH SUBSET PATTERN DATA | |
| END CODE | |

FIG.16A

[EMBROIDERY DATA FOR SECOND SEWING MACHINE]

| EMBROIDERY DATA | SEW TIME |
|---|---|
| THREAD COLOR 5 | 1 MINUTE |
| FD(Fx4E,Fy4E) | |
| FD(Fxe,Fye) | |
| FIFTH SUBSET PATTERN DATA | |
| STOP CODE | |
| THREAD COLOR 7 | 3 MINUTES |
| FD(Fx5E6E,Fy5E6E) | |
| FD(Fxg,Fyg) | |
| SEVENTH SUBSET PATTERN DATA | |
| STOP CODE | |
| THREAD COLOR 8 | 4 MINUTES |
| FD(Fxh,Fyh) | |
| EIGHTH SUBSET PATTERN DATA | |
| STOP CODE | |
| THREAD COLOR 9 | 4 MINUTES |
| FD(Fxi,Fyi) | |
| NINTH SUBSET PATTERN DATA | |
| STOP CODE | |
| THREAD COLOR 10 | 3 MINUTES |
| FD(Fxj,Fyj) | |
| TENTH SUBSET PATTERN DATA | |
| END CODE | |

FIG.16B

EMBROIDERY DATA PROCESSOR, EMBROIDERY SEWING SYSTEM, COMPUTER READABLE MEDIUM AND MULTI-NEEDLE EMBROIDERY SEWING MACHINE

CROSS-REFERENCE TO RELATED APPLICATION

This application is based upon and claims the benefit of priority from the prior Japanese Patent Application 2007-186572, filed on Jul. 18, 2007, the entire contents of which are incorporated herein by reference.

FIELD

The present disclosure relates to an embroidery data processor, an embroidery sewing system, a computer readable medium, and a multi-needle embroidery sewing machine that allows embroidery patterns comprising subset patterns classified by thread color to be sewn by different colors of needle threads by using multiple sets of multi-needle embroidery sewing machines.

BACKGROUND

Conventional sewing controllers of embroidery sewing machines pre-store embroidery data for various patterns such as decorative stitch patterns and one-point patterns. When sewing such embroidery patterns with different colors, a user is first required to select the desired pattern from various types of pre-stored embroidery patterns shown on a display. Subset patterns, each representing a different thread color, are sewn by replacing the needle thread to the required thread color. When executing a sewing operation with an embroidery sewing machine having only one needle bar, a troublesome task of needle thread replacement is required every time sewing of a subset pattern representing a single color has been completed. Such requirement inefficiently prolongs the duration of sewing operation.

To address the above problem, it has been recently proposed to use multiple sets of embroidery sewing machines having a single needle bar to sew an embroidery pattern with different colors. That is, an embroidery pattern comprising different thread colors is sewn simultaneously by using multiple sets of embroidery sewing machines having a single needle bar. Alternatively, an embroidery pattern comprising different thread colors may be sewn at once by a multi-needle embroidery sewing machine provided with multiple needle bars without having to replace the needle thread.

A sewing system capable of multi-color pattern sewing described in JP S59-82891 A comprise four sets of sewing machines each connected to a main controller. Each sewing machine is responsible for sewing with a single type of thread (single color of thread), in this case, sewing machine 1 is assigned the color "red", sewing machine 2 is assigned the color "yellow", sewing machine 3 is assigned the color "green", and sewing machine 4 is assigned the color "blue".

When sewing a pattern comprising the four colors namely red, yellow, green, and blue stored in the main controller, the data corresponding to each color is transmitted separately to each sewing machine from the main controller. More specifically, sewing thread-color data and location data group for the color "red" is transmitted to sewing machine 1, the same for "yellow" to sewing machine 2, the same for "green" to sewing machine 3, and the same for "blue" to sewing machine 4. Thus, each of sewing machines 1 to 4 sews the assigned embroidery pattern subset (red subset, yellow subset, green subset, and blue subset) at the same time.

As another example, JP H09-111638A discloses a sewing data processor capable of displaying an embroidery pattern that efficiently utilizes idle time available until thread replacement. When sewing an embroidery pattern with an embroiderable sewing machine disclosed in JP H09-111638 A, an embroidery pattern is selected among a plurality of embroidery patterns shown on a display, the embroidery pattern comprising a plurality of subset patterns of different thread colors. The sewing data processor calculates the sew time required for embroidering each of the subset patterns based on pattern data representing the selected embroidery pattern. Sewing data processor displays the required sew time for each subset pattern on the display. Thus, JP H09-111638 A allows the user to efficiently direct the idle time available before the next thread replacement to other activities.

Yet, as another example, production management system for embroidery sewing device described in JP-H11-253676 A calculates time period required for sewing a single lot unit of embroidery patterns, comprising groups of embroidery subpatterns, based on pattern data of the embroidery pattern to be sewn and data on count of patterns constituting the single lot unit. Then the production management system allocates the lot to either of embroidery sewing machines M1 to M4 based on data indicating the calculated time period required for sewing the lot. The production management system, then, shows the required time period for sewing each lot allocated to each of the embroidery sewing machines M1 to M4 on a display.

Still yet as another example, JP H06-304372 A discloses a sewing system including first and second automatic sewing machines. The first automatic sewing machine includes a RAM for storing sewing data, a data editor for editing sewing data and restoring the edited data in the RAM, and a data transmitter for transmitting the edited data to the second automatic sewing machine. The second automatic sewing machine executes sewing operation based on the incoming data transmitted from the data transmitter of the first automatic sewing machine.

JP S59-82891 A sews an embroidery pattern with multiple sets of sewing machines having a single needle bar. Thus when sewing an embroidery pattern having ten different colors of subset patterns, a dedicated sewing machine is required for each thread color, amounting to ten sewing machines, and therefore requiring large spacing. Also, when size of subset pattern varies color by color, little time is required for sewing small subset patterns while greater time is required for sewing larger subset patterns, leading to reduced capacity usage of sewing machines having relatively shorter sew time.

JP H09-111638 A merely displays sew time required for each subset pattern for the selected embroidery pattern. Thus, the sew time required for each subset pattern is not utilized for effective control of the sewing operation such as sewing subset patterns in the sequence of shortest to longest sew time or vice versa.

JP H11-253676 A manages amount of sewing work in units of lots, and lots are allocated one by one to either of embroidery sewing machines M1 to M4 so that no single lot is sewn by multiple sewing machines. Such arrangement may create instances where lots are distributed unevenly to embroidery sewing machines M1 to M4, resulting in vast difference in sew time between the sewing machines M1 to M4, which renders work scheduling difficult.

JP H06-304372 A merely transmits sewing data stored in a RAM of a first automatic sewing machine to a second automatic sewing machine and simply executes the same or different work simultaneously without any scheduling features. Thus, sewing work amount and time may very well differ between the first and the second automatic sewing machines.

SUMMARY

An object of the present disclosure is to efficiently sew embroidery patterns comprising subset patterns classified by thread color by using multiple sets of multi-needle embroidery sewing machines provided with multiple needle bars. According to the present disclosure, the embroidery patterns can be sewn efficiently with multiple thread colors without having to replace the threads, and moreover, renders sew time at each multi-needle embroidery sewing machine to be equal or minimally different.

In one aspect, the present disclosure discloses an embroidery data processor that processes embroidery data for sewing an embroidery pattern comprising a plurality of subset patterns on a workpiece cloth with different needle thread colors by using a plurality of multi-needle embroidery sewing machines each provided with an embroidery frame drive mechanism that moves an embroidery frame holding the workpiece cloth in two predetermined directions, the embroidery data processor comprising a sew-time calculator that calculates required sew time for sewing each subset pattern based on subset pattern data being classified by thread color; and an allocator that produces an allocation schedule for allocation of the subset patterns to the multi-needle embroidery sewing machines based on the sew time calculated by the sew-time calculator, the allocation schedule being arranged to distribute equal or minimally-different sew time for each multi-needle embroidery sewing machine.

According to the above described configuration, by executing the sewing operation based on the allocation schedule, the embroidery pattern can be sewn with equal or minimally-different sew time for each multi-needle embroidery sewing machine without thread replacement.

For instance, when making T-shirts bearing a specific embroidery pattern with a couple of multi-needle embroidery sewing machines (hereinafter referred to as a first sewing machine and a second swing machine), a couple of embroidery frames (hereinafter referred to as a first embroidery frame and a second embroidery frame) are provided for holding each T-shirt. The first embroidery frame is attached to the first sewing machine and the first sewing machine sews subset patterns allocated by the allocation schedule. Then, the first embroidery frame is attached to the second sewing machine and the second sewing machine sews the rest of subset patterns allocated by the allocation schedule. At the same time, the second embroidery frame is attached to the first sewing machine and the first sewing machine sews the subset patterns as done for the first embroidery frame. By repeating these sequence of tasks, the couple of sewing machines can be fully utilized to provide reduced sew time and improved efficiency. The same effect can be obtained when executing the sewing operation in the same manner with three or more sewing machines.

In another aspect, the present disclosure discloses an embroidery sewing system including an embroidery data processor that processes embroidery data for sewing an embroidery pattern comprising a plurality of subset patterns on a workpiece cloth with different needle thread colors by using a plurality of multi-needle embroidery sewing machines each provided with an embroidery frame drive mechanism that moves an embroidery frame holding the workpiece cloth in two predetermined directions, a first multi-needle embroidery sewing machine having a communication element capable of communicating data processed by the embroidery data processor to external components, and a second multi-needle embroidery sewing machine having a receiving element capable of receiving data transmitted by the first multi-needle embroidery sewing machine, the embroidery data processor comprising a sew-time calculator that calculates required sew time for sewing each subset pattern based on subset pattern data being classified by thread color; and an allocator that produces an allocation schedule for allocation of the subset patterns to the first and the second multi-needle embroidery sewing machines based on the sew time calculated by the sew-time calculator, the allocation schedule being arranged to distribute equal or minimally-different sew time for the first and the second multi-needle embroidery sewing machines.

According to the above described configuration, the first multi-needle embroidery sewing machine is allowed to sew embroidery patterns allocated to it based on various types of data processed by the embroidery data processor. Similarly, the second multi-needle embroidery sewing machine is also allowed to sew embroidery patterns allocated to it based on the transmitted data.

Yet, in another aspect, the present disclosure discloses an embroidery sewing system including an embroidery data processor having a communicating element capable of communicating various processed data to external components, first and second multi-needle embroidery sewing machines each having a receiving element capable of receiving data transmitted by the embroidery data processor, the embroidery data processor comprising a sew-time calculator that calculates required sew time for sewing each subset pattern based on subset pattern data being classified by thread color; and an allocator that produces an allocation schedule for allocation of the subset patterns to the first and second multi-needle embroidery sewing machines based on the sew time calculated by the sew-time calculator, the allocation schedule being arranged to distribute equal or minimally-different sew time for the first and the second multi-needle embroidery sewing machines.

According to the above described configuration, each of the first and the second multi-needle embroidery sewing machines is allowed to sew embroidery patterns allocated to them based on incoming data transmitted by the embroidery data processor.

Still yet in another aspect, the present disclosure discloses a computer readable medium storing an embroidery data processing program for use as an embroidery data processor that processes embroidery data for sewing an embroidery pattern comprising a plurality of subset patterns on a workpiece cloth with different needle thread colors by using a plurality of multi-needle embroidery sewing machines each provided with an embroidery frame drive mechanism that moves an embroidery frame holding the workpiece cloth in two predetermined directions, the embroidery data processing program stored in the computer readable medium comprising instructions for calculating required sew time for sewing each subset pattern based on subset pattern data being classified by thread color; and instructions for producing an allocation schedule for allocation of the subset patterns to the multi-needle embroidery sewing machines based on the sew time calculated, the allocation schedule being arranged to distribute equal or minimally-different sew time for each multi-needle embroidery sewing machine.

According to the above described configuration, favorable effects provided by the embroidery data processor can be obtained by executing the medium storing the embroidery data processing program by a computer.

Still yet in another aspect, the present disclosure discloses a multi-needle embroidery sewing machine that processes embroidery data for sewing an embroidery pattern comprising a plurality of subset patterns on a workpiece cloth with different needle thread colors in cooperation with one or more external multi-needle embroidery sewing machine and being provided with an embroidery frame drive mechanism that moves an embroidery frame holding the workpiece cloth in two predetermined directions, the multi-needle embroidery sewing machine comprising a sew-time calculator that calculates required sew time for sewing each subset pattern based on subset pattern data being classified by thread color; and an allocator that produces an allocation schedule for allocation of the subset patterns to the multi-needle embroidery sewing machine itself and the external multi-needle embroidery sewing machine based on the sew time calculated by the sew-time calculator, the allocation schedule being arranged to distribute equal or minimally-different sew time for the multi-needle embroidery sewing machine itself and the external multi-needle embroidery sewing machine.

According to the above described configuration, by executing the sewing operation based on the allocation schedule, the embroidery pattern can be sewn with equal or minimally-different sew time for the multi-needle embroidery sewing machine itself and the external multi-needle embroidery sewing machine without thread replacement. Thus, favorable effects provided by the aforementioned embroidery data processor can be obtained.

BRIEF DESCRIPTION OF THE DRAWINGS

Other objects, features and advantages of the present disclosure will become clear upon reviewing the following description of the illustrative aspects with reference to the accompanying drawings, in which.

FIG. 3 schematically describes thread color information retained at the first multi-needle embroidery sewing machine;

FIG. 4 schematically describes thread color information retained at the second multi-needle embroidery sewing machine;

FIGS. 5A and 5B schematically describe a data configuration of embroidery data;

FIG. 9 schematically describes a data configuration of embroidery data including ten subset patterns;

FIG. 10 is a descriptive view indicating a plurality of combinations for overlapping thread colors;

FIG. 11 is a descriptive view indicating sew time in each combination and their difference;

FIG. 12A is a descriptive view indicating an end coordinate of sixth subset pattern where discontinuity of sewing operation occurs;

FIG. 12B is a descriptive view indicating end coordinates of fourth to sixth subset patterns where discontinuity of sewing operation occurs;

FIG. 14A schematically indicates an embroidery data for the first multi-needle embroidery sewing machine;

FIG. 14B schematically indicates an embroidery data for the second multi-needle embroidery sewing machine;

FIG. 15 schematically indicates an allocation schedule to be allocated to two sets of multi-needle embroidery sewing machines;

FIG. 16A schematically indicates an embroidery data for the first multi-needle embroidery sewing machine;

FIG. 16B schematically indicates an embroidery data for the second multi-needle embroidery sewing machine;

DETAILED DESCRIPTION

An embroidery data processor, an embroidery sewing system, computer readable medium, and a multi-needle embroidery sewing machine of the present disclosure sews a single embroidery pattern comprising a plurality of subset patterns by cooperative operation of a couple of multi-needle embroidery sewing machines without thread replacement. Moreover, the subset patterns are allocated to the couple of sewing machines so that sew time of the sewing machines are substantially equal or have very little difference.

One exemplary embodiment of the present disclosure will be described with reference the accompanying drawings.

Figure 1:
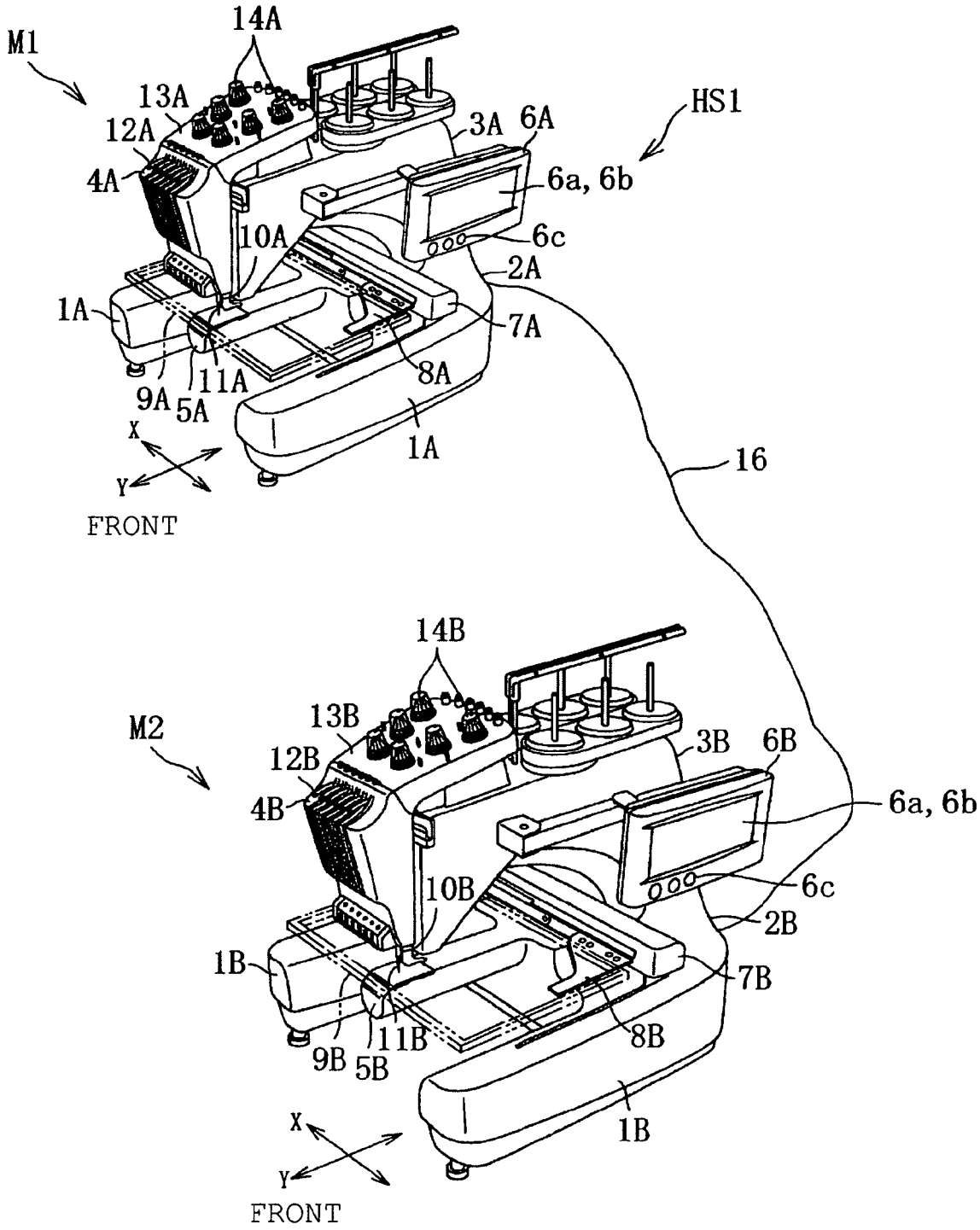
FIG. 1 is a schematic view of an embroidery sewing system according to one illustrative aspect of the present disclosure.

FIG. 1 describes an embroidery sewing system HS1 including a first multi-needle embroidery sewing machine M1 (also hereinafter referred to as first sewing machine M1) and a second multi-needle embroidery sewing machine M2 (also hereinafter referred to as a second sewing machine M2). The first sewing machine M1 and the second sewing machine M2 maintain a parent-child relationship over an interconnect 16, where first sewing machine M1 is the parent and the second sewing machine M2 is the child. The first sewing machine M1 is provided with an embroidery data processor. First and second sewing machines M1 and M2, basically assuming identical configuration, will be described at once. Components of first sewing machine M1 are hereinafter represented by appending suffix "A" and components of second sewing machine M2 with suffix "B" to their reference symbols.

First and second sewing machines M1 and M2 each comprises feet 1A (1B), a pillar 2A (2B), an arm 3A (3B), a needle-bar case 4A (4B), a cylinder bed 5A (5B), and an operation panel 6A (6B). Feet 1A (1B) provide support for first and second sewing machines M1 and M2 in their entirety. Pillar 2A (2B) stands at the rear end of feet 1A (1B). Arm 2A (2B) extend forward from the upper portion of pillar 2A (2B). A needle-bar case 4A (4B) is attached on the front end of arm 3A (3B. A cylinder bed 5A (5B) extends forward from the lower end of pillar 2A (2B).

Above feet 1A (1B), a carriage 7A (7B) is provided so as to be oriented laterally. Carriage 7A (7B) contains an X-directional drive mechanism (not shown) driven by an X-axis drive motor 32A (32B) (refer to FIG. 2). The X-directional drive mechanism drives a frame mount 8A (8B) in the X-direction (lateral direction), frame mount 8A (8B) being provided integrally on the front side of carriage 7A (7B). The left and right feet 1A (1B) contain a Y-directional drive mechanisms (not shown) driven by a Y-axis drive motor 33A (33B) (refer to FIG. 2). The Y-directional drive mechanism drives carriage 7A (7B) in the Y-direction (longitudinal direction). The X-directional and Y-directional drive mechanism constitute an embroidery frame drive mechanism.

A workpiece cloth (not shown) on which embroidery is formed is held by a rectangular embroidery frame 9A (9B) indicated by double-dot chain line in FIG. 1. Embroidery frame 9A (9B) is mounted on a left and right pair of frame mount 8A (8B). Frame mount 8A (8B) is moved in the X-direction by the X-directional drive mechanism. Carriage 7A (7B) is moved in the Y-direction by the Y-directional drive mechanism. Thus, embroidery frame 9A (9B) is moved in the Y-direction in synchronism with carriage 7A (7B) and in the X-direction with frame mount 8A (8B), to feed the workpiece cloth. Thus, the workpiece cloth held by embroidery frame 9A (9B) is moved in two directions namely, the X-direction and the Y-direction.

A needle bar case 4A (4B) is provided that contains six needle bars 10A (10B) arranged vertically movably, each needle bar 10A (10B) having a sewing needle 11A (11B) attached on its lower end. Needle-bar case 4A (4B) also has six vertically movable thread take-ups 12A (12B) corresponding to each needle bar 10. On the upper end of needle bar case 4A (4B), a thread tension base 13A (13B) made of synthetic resin is attached that is slightly inclined upward toward the rear. Thread tension base 13A (13) has six thread tension regulators 14A (14B) that supply needle threads to each sewing needle 11A (11B).

Figure 2A:
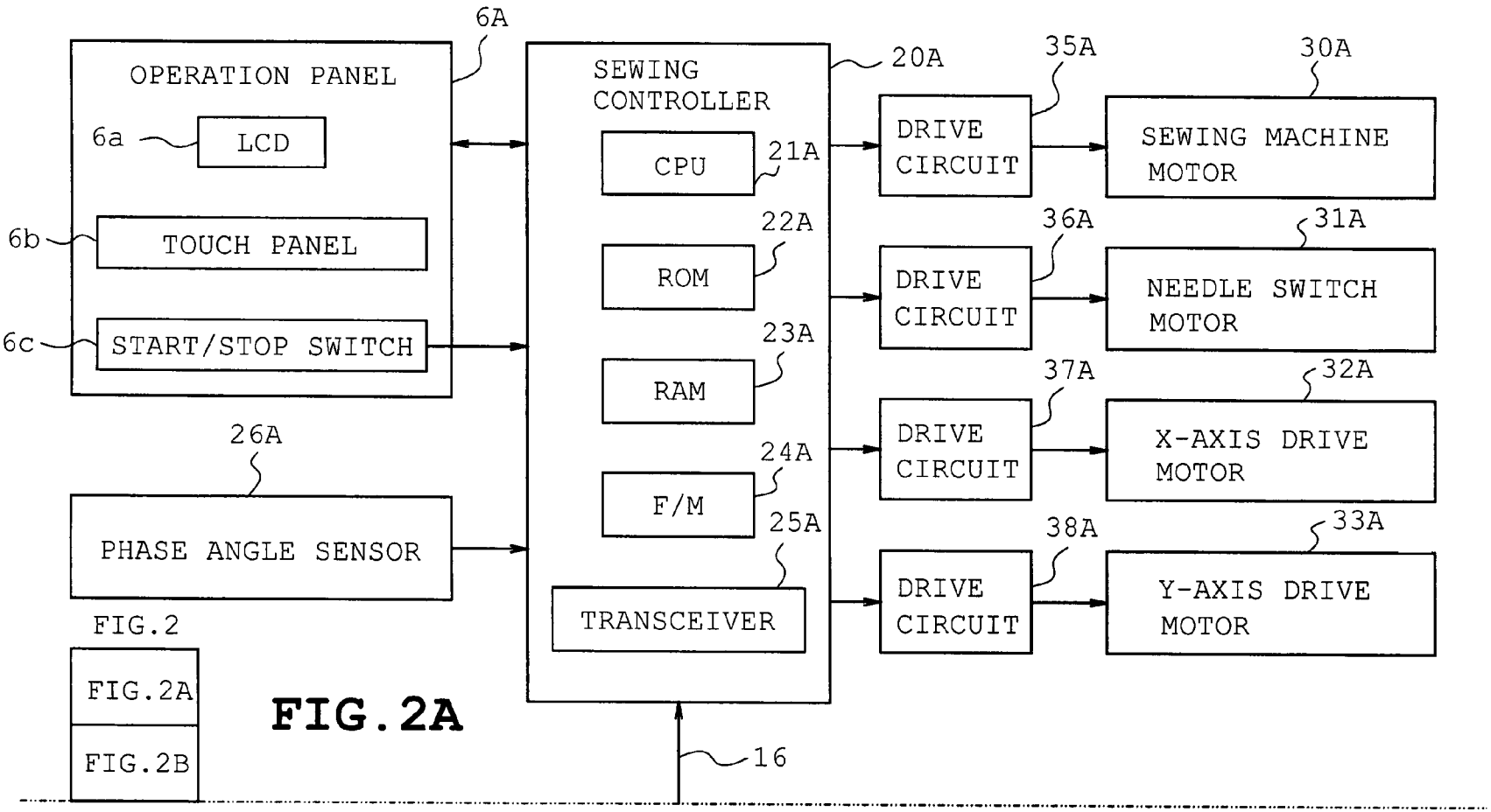
FIG. 2 is a block diagram of a control system of first and second multi-needle embroidery sewing machine.
Figure 2B:
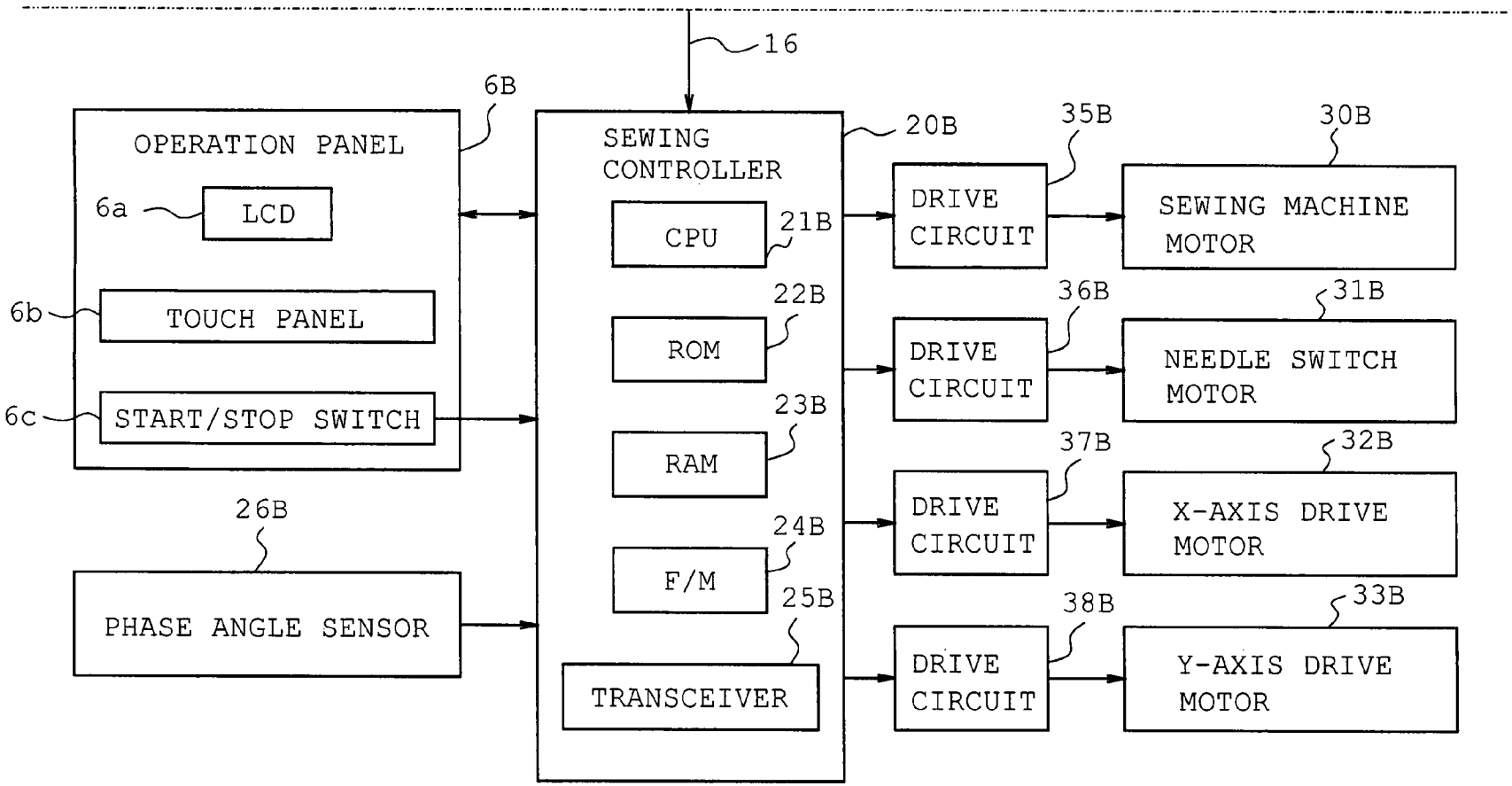

Provided inside arm 3A (3B) is a needle-bar selection mechanism (not shown) driven by a needle-bar switch motor 31A (31B) (refer to FIG. 2). When changing the needle thread (when replacing the needle thread), needle-bar case 4A (4B) is moved in the X-direction integrally with thread tension base 13A (13B) by the needle-bar selection mechanism driven by needle-bar switch motor 31A (31B), and one of the six needle bars 10A (10B) and the corresponding thread take-up 12A (12B) are selected and placed in a drive position.

Needle bar 10A (10B) and thread take-up 12A (12B) in the drive position are vertically driven in synchronism by a sewing machine motor 31A (31B) shown in FIG. 2 to form embroidery stitches on the workpiece cloth in cooperation with a rotary shuttle (not shown) provided in the front end of cylinder bed 5A (5B). As described earlier, the workpiece cloth is retained by embroidery frame 9A (9B) situated above cylinder bed 5A (5B). Further, on the right side surface of arm 3A (3B), a foldable operation panel 6A (6B) is provided which is configured as a touch panel.

As shown in FIG. 1, operation panel 6A (6B) is provided with a large, laterally elongate liquid crystal display 6*a*. Liquid crystal display 6*a* has a touch panel 6*b* provided on its surface. Touch panel 6*b* has a plurality of transparent touch keys that are associated with plurality types of pattern images and function names displayed on liquid crystal display 6*a* (hereinafter referred to as LCD 6*a*). Further, a start/stop switch 6*c* for instructing start and stop of sewing operation is provided below LCD 6*a* along with other switches.

Next, a description will be given on controls systems for first and second sewing machines M1 and M2.

Referring to FIG. 2, a sewing controller 20A (20B) is configured by a microcomputer comprising components such as a CPU 21A (21B), a ROM 22A (22B), a RAM 23A (23B), a flash memory (F/M) 24A (24B), and a transceiver 25A (25B).

Flash memory 24A, 24B is a programmable non-volatile flash memory that allows stored data to be maintained without power supply. Transceiver 25A is a communicating element that transmits and receives various data to and from sewing controller 20B of the second sewing machine M2. Transceiver 25B is a communicating element that transmits and receives various data to and from sewing controller 20A of the first sewing machine M1.

Sewing controller 20A (20B) establishes connections with operation panel 6A (6B), a phase angle sensor 26A (26B) that detects rotational phase angle of the main shaft, and drive circuits 35A (35B), 36A (36B), 37A (37B), and 38A (38B) for sewing machine motor 30A (30B), needle-bar switch motor 31A (31B), X-axis drive motor 32A (32B), and Y-axis drive motor 33A (33B) respectively.

ROM 22A of first sewing machine M1 stores programs such as an embroidery data processing control program. RAM 23A (23B) allocates, in addition to areas for various data storage purposes, areas for various buffers, counters, memory, and the like, for temporary storage of calculation result produced by CPU 21A (21B).

Referring to FIG. 3, flash memory 24A stores a mapping of the six needle bars 10A (needle bar 1 to 6) to thread color numbers (thread color 1 to 6) representing the color of needle thread threaded to each needle bar 10A. Similarly, as shown in FIG. 4, flash memory 24B stores a mapping of the six needle bars 10B (needle bar 1 to 6) to thread color numbers (thread color 1 to 6) representing the color of needle thread threaded to each needle bar 10B. In the present exemplary embodiment, "thread color 5" and "thread color 6" are registered to both first sewing machine M1 and second sewing machine M2.

ROM 22A pre-stores embroidery data which is configured, for example, as indicated in FIG. 5. The embroidery data includes 10 subset patterns (first subset pattern to tenth subset pattern) and the embroidery data is sewn with 10 colors of needle threads. That is, the first to tenth subset patterns are classified by thread color. The first subset pattern data, located at the beginning of the embroidery data includes needle-thread color number represented as "thread color 1", "feed data (Fxa, Fya)", "embroidery data" comprising a plurality of needle drop position data, and "stop code".

The second to ninth subset pattern data include needle-thread color number represented as "thread color 2" to "thread color 9", "feed data (Fxb, Fyb)" to "feed data (Fxi, Fyi)", "embroidery data" comprising a plurality of needle drop position data, and "stop code".

Feed data (Fxa, Fya) contained in the leading portion of the first subset pattern data is used for transferring embroidery frame 9A from the predetermined origin of the coordinate system to the sewing start position of the first subset pattern when starting the sewing operation. Likewise, "feed data (Fxb, Fyb)" to "feed data (Fxi, Fyi)" contained in the leading portions of the second subset pattern data to the ninth subset pattern data are used for transferring embroidery frame 9A (9B) from the end location of the previously sewn pattern among the first to ninth subset patterns to the start location of the subsequently sewn pattern among the second to tenth subset patterns.

Figure 6:
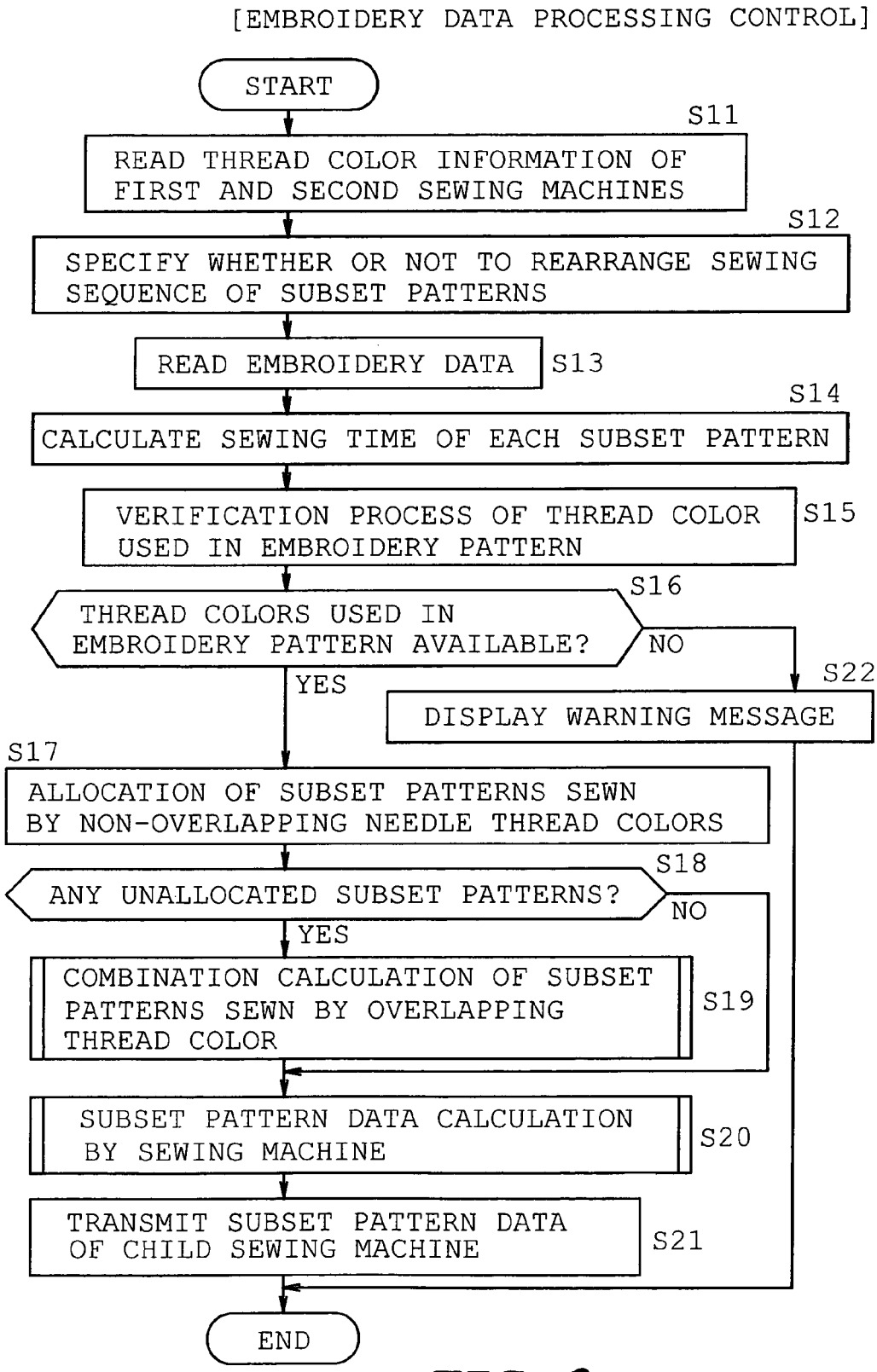
FIG. 6 is a flowchart of an embroidery data processing control.

Next, a description will be given on embroidery data processing control executed by sewing controller 20A of first sewing machine M1 based on flowchart indicated in FIG. 6. Reference symbols Si (i=11, 12, 13 . . . ) indicate each step of the control flow.

Before starting the control, the user is required to select a desired embroidery pattern from a plurality of embroidery patterns displayed on LCD 6*a* through operation of control panel 6A of first sewing machine M1. Then, after selecting the desired pattern, embroidery data processing control is started upon operation of a "sew key" provided on touch panel 6*b*. As the first step of the embroidery data processing control, thread color information (refer to FIGS. 3 and 4) preset in flash memory 24A and 24B of first and second sewing machines M1 and M2 is read through transceiver 25A (S11).

Then, a sewing sequence setting screen is displayed on LCD 6*a* to allow the user to select whether to "rearrange sewing sequence" or "maintain sewing sequence". Thus, sewing sequence of the subset patterns may or may not be changed depending on user selection of either "rearrange sewing sequence" or "maintain sewing sequence" (S12).

Then, embroidery data of the selected embroidery pattern is read into an embroidery data memory of RAM 23A from ROM 22A (S13). If the embroidery pattern comprises a plurality of subset patterns, sew time is calculated for each subset pattern. The calculated sew time is stored with mapping to the corresponding subset pattern (S14). The sew time is calculated based on subset pattern data of each subset pattern and a specified sewing speed; more specifically by calculating the sum of time expended on each single sewing cycle which corresponds to the sum of the distance between each needle drop point.

Then, based on the embroidery data of the selected embroidery pattern, a verification process is executed (S15) for verifying whether or not all the thread colors required for sewing the embroidery pattern are set to either of first and second sewing machine M1 and M2 or first and second sewing machine M1 and M2 taken together. If the verification process finds a lack of required thread color (S16: No), a warning message is displayed on LCD 6*a* (S22) and the embroidery data processing control is terminated.

Figure 7:
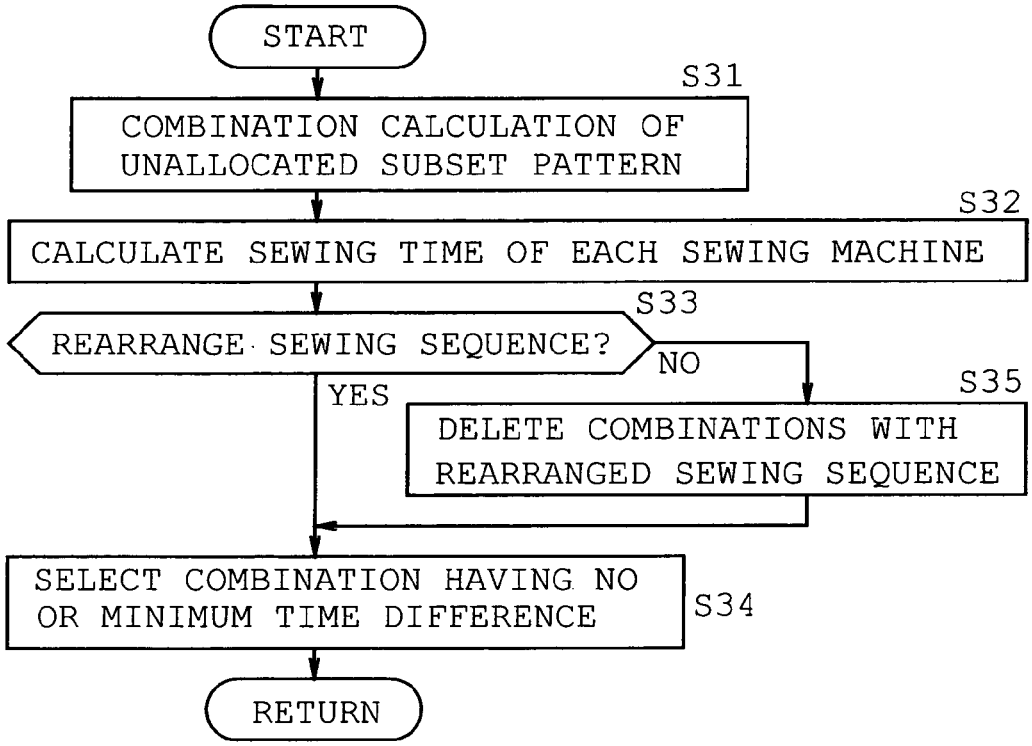
FIG. 7 is a flowchart of a combination calculation control for sewing subset patterns.

If all the thread colors required for sewing the embroidery pattern are available (S16: Yes), allocation process is executed (S17). The allocation process allocates the subset patterns sewn by unique thread colors to either of first and second sewing machines M1 or M2. If any of the subset patterns remains unallocated by the allocation process; more specifically, in case a thread color exists in both first sewing machine M1 and second sewing machine M2 (hereinafter also referred to as an overlapping thread color), and a subset pattern exists that has not been allocated a thread color by the allocation process (S18: Yes), a combination calculating process (refer to FIG. 7) is executed (S19) to determine the combination to be applied on the unallocated subset pattern sewn by the overlapping thread color.

As the first step of the combination calculation process, possible combinations to be applied to the unallocated subset patterns are calculated (S31). More specifically, using the overlapping needle thread color, first and second sewing machines M1 and M2, and unallocated subset patterns as parameters, a plurality of possible combinations between the parameters are calculated. The combinations may include combinations that have identical parameters but different sewing sequence. Sew time expended at first and second sewing machines M1 and M2 are calculated for each of the calculated combinations (S32).

Then, according to the settings made at S12, if the sewing sequence is to be rearranged (S33: Yes), a combination having no or minimum sew time difference between first and second sewing machines M1 and M2 is selected among the combinations calculated at S31 (S34). Then, the combination calculation process returns to S20 of the embroidery data processing control. On the other hand, according to the settings at S12, if the sewing sequence need not be rearranged (S33: No), combinations having identical parameters but different sewing sequence is deleted from the combinations calculated at S31 (S35). Then, a combination having no or minimum sew time difference between first and second sewing machines M1 and M2 is selected (S34).

Figure 8:
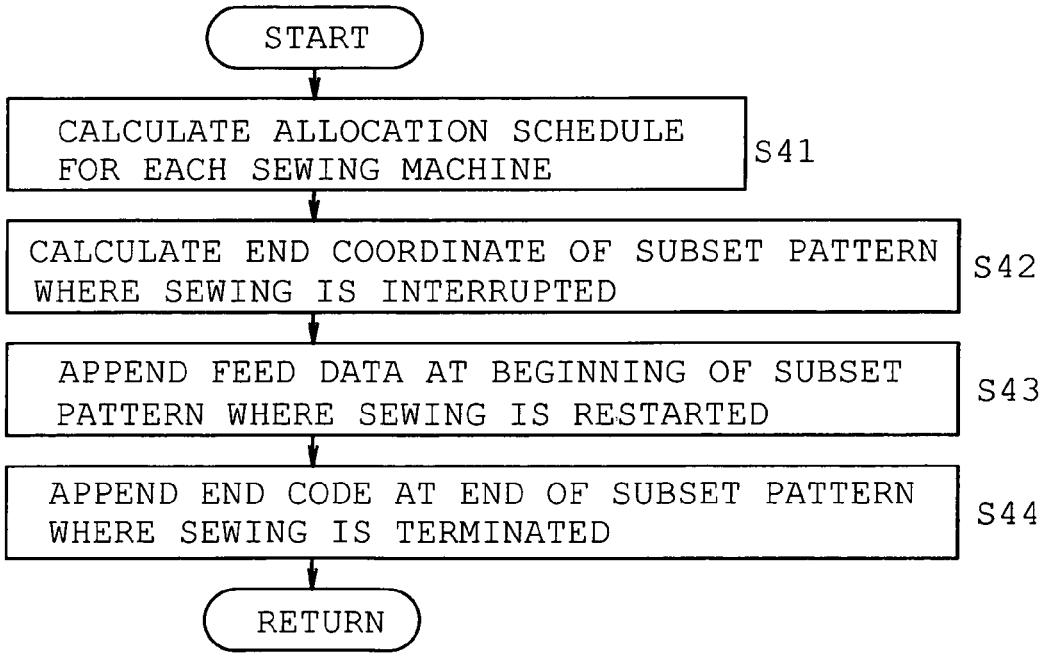
FIG. 8 is a flowchart of a subset pattern data calculation control.

Next, the embroidery data processing control proceeds to a calculation control (refer to FIG. 8) that calculates subset pattern data to be sewn by first and second sewing machines M1 and M2 respectively (S20).

As the first step of this control, allocation schedule is calculated for allocation of the subset patterns to first and second sewing machines M1 and M2, respectively (S41).

The calculated allocation schedule reflects the most desirable combination determined at S34 for sewing operations to be performed at both first and second sewing machines M1 and M2. A dedicated allocation schedule is produced for first and second sewing machines M1 and M2 respectively. If the determined combination requires rearrangement of sewing sequence of the subset patterns, sewing sequence of the subset patterns is rearranged accordingly.

Then, based on allocation schedule of subset patterns calculated at S41 for distribution to first and second sewing machines M1 and M2, end coordinates of the subset patterns, where sewing operation is interrupted, in other words, where sewing discontinuation occurs are calculated (S42). Stated differently, in case the allocation schedules for first and second sewing machines M1 and M2 determined at S41 involves alternations in the predetermined sequential array of subset patterns such as: starting the sewing operation with the subset pattern originally located after the first subset pattern, or discontinuation in the original sequential array of the subset patterns, the end coordinates of the subset patterns subject to such alteration is calculated.

Then, based on the allocation schedule of first and second sewing machines M1 and M2 and the end coordinates calculated at S42, feed data is appended for accessing the beginning of the subset pattern to be sewn initially as the result of alteration in sewing sequence (S43). Stated differently, feed data is modified in order to move embroidery frame 9A and 9B from the end location of previously sewn subset pattern data to the start location of the subsequently sewn subset pattern. Then, though not originally located at the end of the predetermined sequential array of subset patterns, the lastly sewn subset pattern data according to the current allocation schedule is appended with an end code at its data end (S44). Then, allocation schedule calculation returns to S21 of the embroidery data processing control.

In the embroidery data processing control, the subset pattern data required by the allocation schedule to be sewn by first sewing machine M1 is stored in the embroidery data memory of RAM 23A. On the other hand, the subset pattern data required by the allocation schedule to be sewn by second sewing machine M2 is transmitted to the second sewing machine M2 serving as the child machine through transceiver 25A and 25B (S21). Thus, second sewing machine M2 stores subset pattern data received through transceiver 25B into the embroidery data memory allocated in RAM 23B.

Next, a description will be given on the operation of embroidery data processing that renders embroidery sewing through allocation of each of the subset patterns indicated in FIG. 5 to the first or the second sewing machine M1 and M2. The description will be given through an example in which first sewing machine M1 is provided with six needle-thread colors numbered from thread color 1 to 6, whereas the second sewing machine M2 is provided with six needle-thread colors numbered from thread color 5 to 10.

When the embroidery pattern (refer to embroidery data indicated in FIG. 5) comprising ten subset patterns are selected by the user, sew time is calculated for each subset pattern. Then, as shown in FIG. 9, subset patterns (1 to 10) and their corresponding sew time are stored. Then, based on the embroidery data, first to fourth subset patterns having unique thread colors (thread colors 1 to 4) are allocated to first sewing machine M1 and seventh to tenth subset patterns including overlapping thread colors (thread colors 7 to 10) are allocated to second sewing machine M2.

Referring to FIG. 10, four different combinations (combination numbers 1 to 4) are calculated for overlapping "thread color 5" for sewing "subset pattern 5" and "thread color 6" for sewing "subset pattern 6". Combination number "3" has the sewing sequence of first sewing machine M1 rearranged from the original sequence such that subset pattern "6" is sewn instead of subset pattern "5"; whereas the sewing sequence of second sewing machine M2 is rearranged so that subset pattern "5" is sewn instead of subset pattern "6".

Referring to FIG. 11, for each of the four combinations (combination numbers 1 to 4), sew time of first sewing machine M1 serving as the parent machine and the second sewing machine M2 serving as the child sewing machine are calculated respectively. If it has been set at S12 that sewing sequence is not to be rearranged, "combination number 3" having rearranged sewing sequence is deleted from the four combinations. Then among the remaining three combinations (combination numbers 1, 2, and 4), "combination number 4" having minimum sew time difference of "2 minutes" is selected.

Thus, as shown in FIG. 13, "subset pattern 5" and "subset pattern 6" are allocated to first sewing machine M1. Then, based on "combination number 4" determined in the above described manner, six subset patterns (subset patterns 1 to 6) are allocated as the embroidery data to be sewn by first sewing machine M1 (refer to FIG. 14A), whereas four subset patterns (subset patterns 7 to 10) are allocated as the embroidery data to be sewn by second sewing machine M2 (refer to FIG. 14B).

Next, referring to FIG. 12A, when sewing the embroidery pattern with first and second sewing machines M1 and M2 based on the allocation schedule, the end coordinate (X6E, Y6E) of the subset pattern (sixth subset pattern) where sewing interruption, in other words, sewing discontinuation occurs is calculated. Then, "end code" is appended at the data end of the embroidery data for first sewing machine M1, more specifically, at the data end of the sixth subset pattern as shown in FIG. 14A.

Then, referring to FIG. 14B, at the beginning of the embroidery data for second sewing machine M2, more specifically at the beginning of the foremost "seventh subset pattern", feed data FD is appended for accessing the end coordinate "X6E, Y6E" of the sixth subset pattern immediately preceding the seventh subset pattern. The seventh subset pattern, in this case, is the first sewn data by second sewing machine M2. Thus, feed data FD is represented as feed data "Fx6E, Fy6E" for accessing "X6E, Y6E" from the origin of the coordinate system. Finally, the embroidery data for second sewing machine M2 indicated in FIG. 14B is transmitted to second sewing machine M2.

Based on the embroidery data for first sewing machine M1 indicated in FIG. 14A, first sewing machine M1 sews first to sixth subset patterns on the workpiece cloth set on embroidery frame 9A at once. Then, embroidery frame 9A is removed from first sewing machine M1 and attached to second sewing machine M2. Then, based on the embroidery data for second sewing machine M2 indicated in FIG. 14B, second sewing machine M2 sews the remaining seventh to tenth subset patterns at once.

As described earlier, four different combinations (combination number 1 to 4) are calculated (refer to FIG. 10) to determine the allocation of the overlapping thread color namely "thread color 5" for sewing "subset pattern 5" and "thread color 6" for sewing "subset pattern 6". Then, if rearrangement of sewing sequence has been set at S12, all of the four calculated combinations are valid. In such case, among the sew time information of the four combinations given in FIG. 11, "combination number 3" providing equal sew time for the parent and the child machine, in other words, providing "0 minute" sew time difference between the parent and the child machine is selected.

Then, referring to FIG. 15, "subset pattern 6" is allocated to first sewing machine M1, and "subset pattern 5" is allocated to second sewing machine M2. Based on "combination number 3" determined in the above manner, five subset patterns (subset pattern 1 to 4 and 6) are allocated as embroidery data to be sewn by first sewing machine M1 (refer to FIG. 16A), and five subset patterns (subset pattern 5 and 7 to 10) are allocated as embroidery data to be sewn by second sewing machine M2 (refer to FIG. 16B).

Of note is that sewing sequence of "subset pattern 5" and "subset pattern 6" are rearranged so that "subset pattern 5" is incorporated into the embroidery data for second sewing machine M2, whereas "subset pattern 6" is incorporated into the embroidery data for first sewing machine M1.

Then, as described earlier, end coordinates "X4E, Y4E", "X5E, Y5E", and "X6E, Y6E" are calculated (refer to FIG. 12B) for fourth to sixth subset patterns where sewing operation is interrupted, in other words, where sewing discontinuation occurs. Then, as shown in FIG. 16A, first sewing machine M1 appends at the beginning of "sixth subset pattern", the lastly sewn sewing data by the first sewing machine M1, feed data FD represented as "Fx4E5E, Fy4E5E" for accessing the end coordinate "X5E, Y5E" of the fifth subset pattern from the end coordinate "X4E, Y4E" of the forth subset pattern. Further, "end code" is appended at the data end of "sixth subset pattern".

Referring now to FIG. 16B, second sewing machine M2 appends at the beginning of the "fifth subset pattern" the first sewn sewing data by the second sewing machine M2, feed data FD represented as "Fx4E, Fy4E" for accessing the end coordinate "X4E, Y4E" of the previously sewn fourth subset pattern from the origin of the coordinate system such that "Fx4E, Fy4E" is located before the existing feed data "Fxe, Fye". Second sewing machine M2 further appends at the beginning of the subsequently sewn "seventh subset pattern", feed data FD represented as "Fx5E6E, Fy5E6E" for accessing the end coordinate of the previously sewn "sixth subset pattern" from the end coordinate "X5E, Y5E", such that "Fx5E6E, Fy5E6E" is located before the existing feed data "Fxg, Fyg". Finally, embroidery data for second sewing machine M2 as indicated in FIG. 16B is transmitted to second sewing machine M2.

Based on embroidery data for first sewing machine M1 shown in FIG. 16A, first sewing machine M1 sews first to fourth subset patterns and the sixth subset patterns at once on the workpiece cloth set on embroidery frame 9A. Then, embroidery frame 9A is removed from first sewing machine M1 and attached to second sewing machine M2. Then, based on the embroidery data for second sewing machine M2 indicated in FIG. 16B, second sewing machine M2 sews the remaining fifth subset pattern, and seventh to tenth subset patterns at once.

A second exemplary embodiment of the present disclosure will be described with reference to the drawings.

Figure 17:
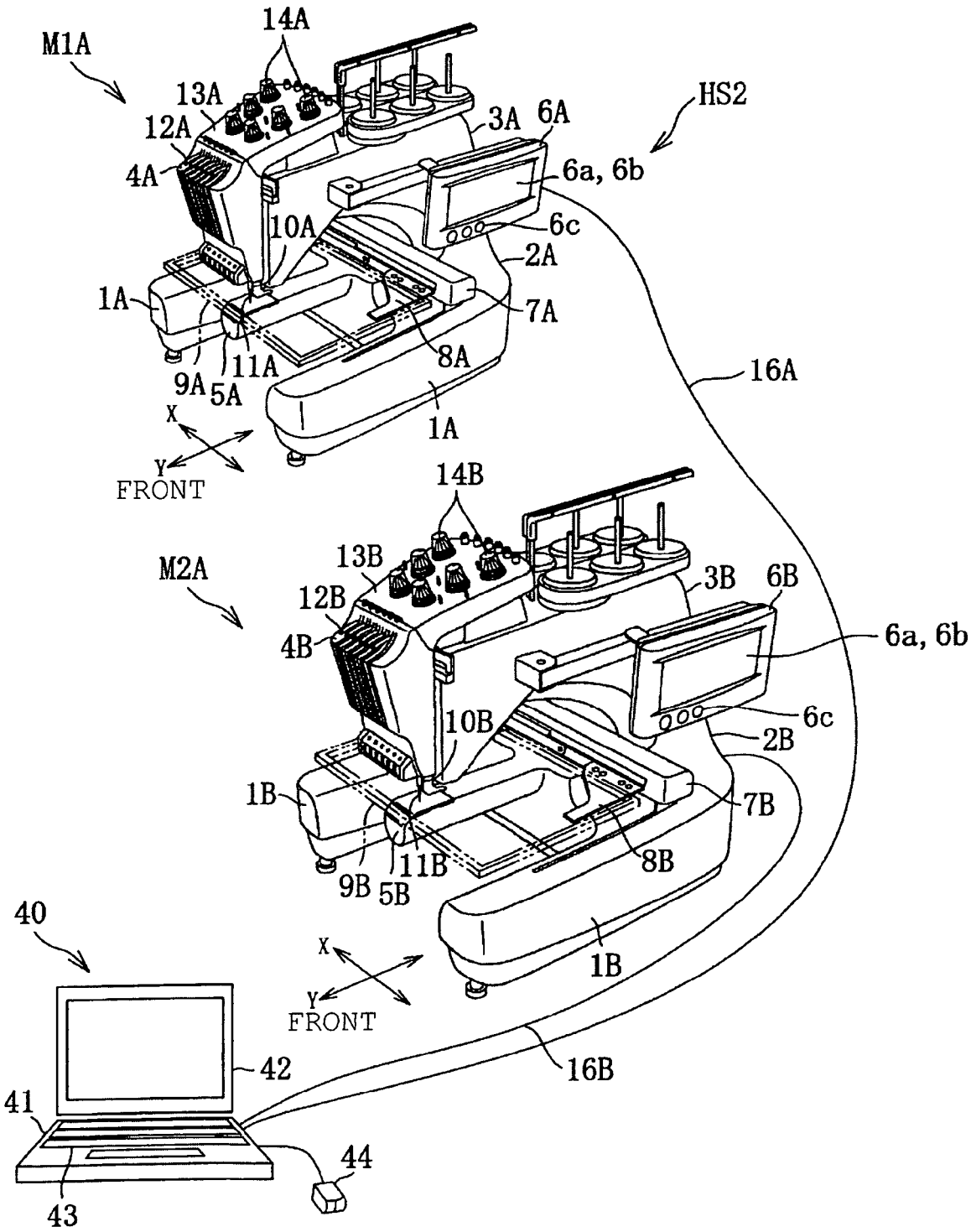
FIG. 17 is a schematic view of an embroidery sewing system according to a second illustrative aspect of the present disclosure.

Referring to FIG. 17, an embroidery sewing system HS2 includes an embroidery data processor 40 comprising a microcomputer, and two sets of multi-needle embroidery sewing machines M1A and M2A (hereinafter also referred to as first sewing machine M1A and second sewing machine M2A). Embroidery data processor 40, first sewing machine M1A, and second sewing machine M2A are connected by interconnects 16A and 16B. The components of first and second sewing machines M1A and M2A, being configured by components that are basically identical to first and second sewing machines M1 and M2 described in the first exemplary embodiment, will be described with identical reference symbols and will not be described in detail.

Figure 18:
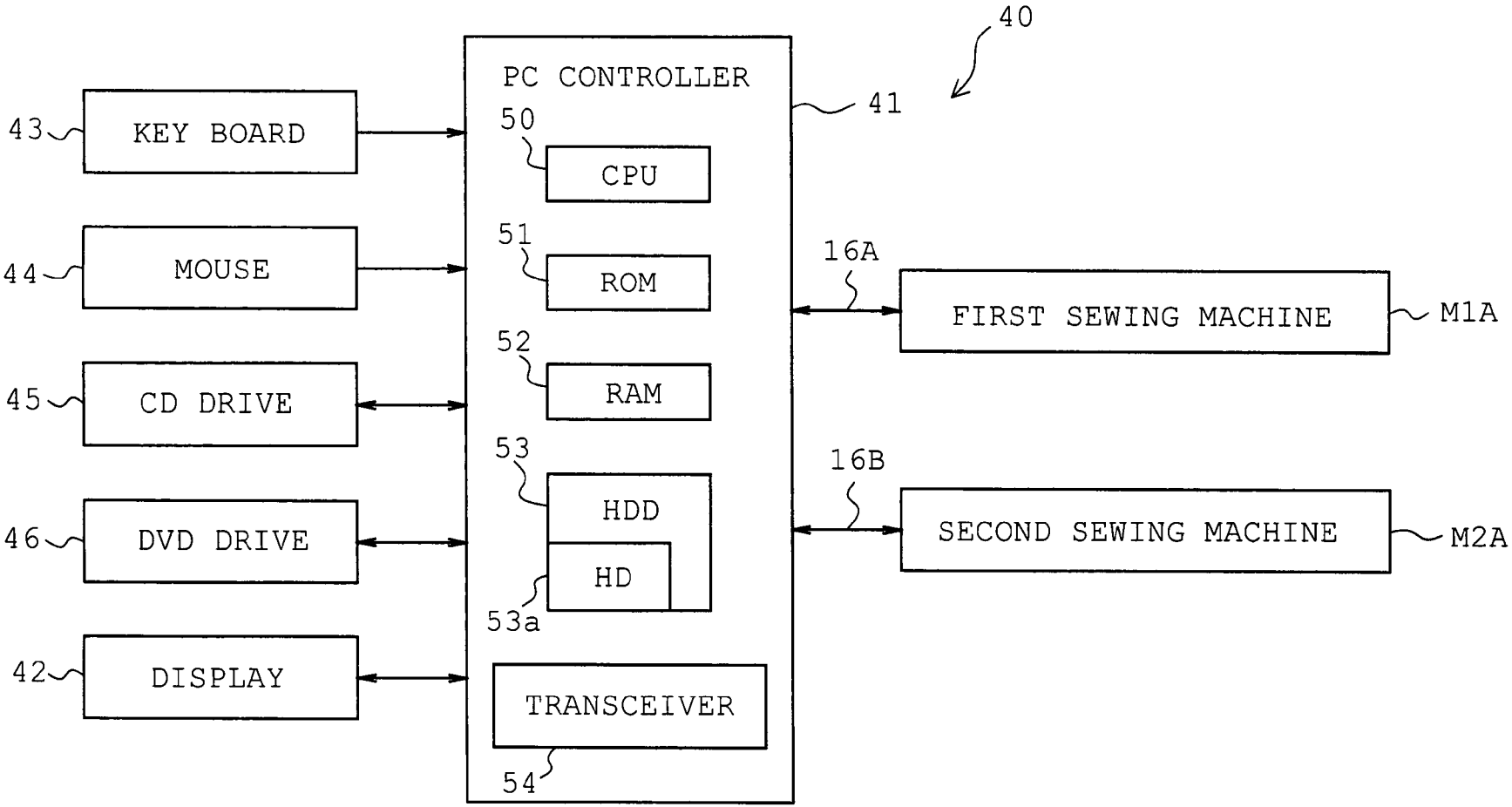
FIG. 18 is a block diagram of an embroidery data processor.

Referring again to FIG. 17, embroidery data processor is configured by a microcomputer provided with components such as a PC controller 41, a display 42, and a key board 43. As shown in FIG. 18, PC controller 41 includes a CPU 50, a ROM 51, a RAM 52, a hard disc drive (HDD) 53 provided with a hard disc (HD) 53*a*, a transceiver 54, and data bus (not shown) interconnecting these components. Controller 41 is provided with components such as keyboard 43 connected to the data bus not shown, mouse 44, a CD drive 45, a DVD drive 46 and display 42. Embroidery data processor 40 is connected to first and second sewing machines M1A and M2A through interconnects 16A and 16B to allow mutual data communication.

Figure 19:
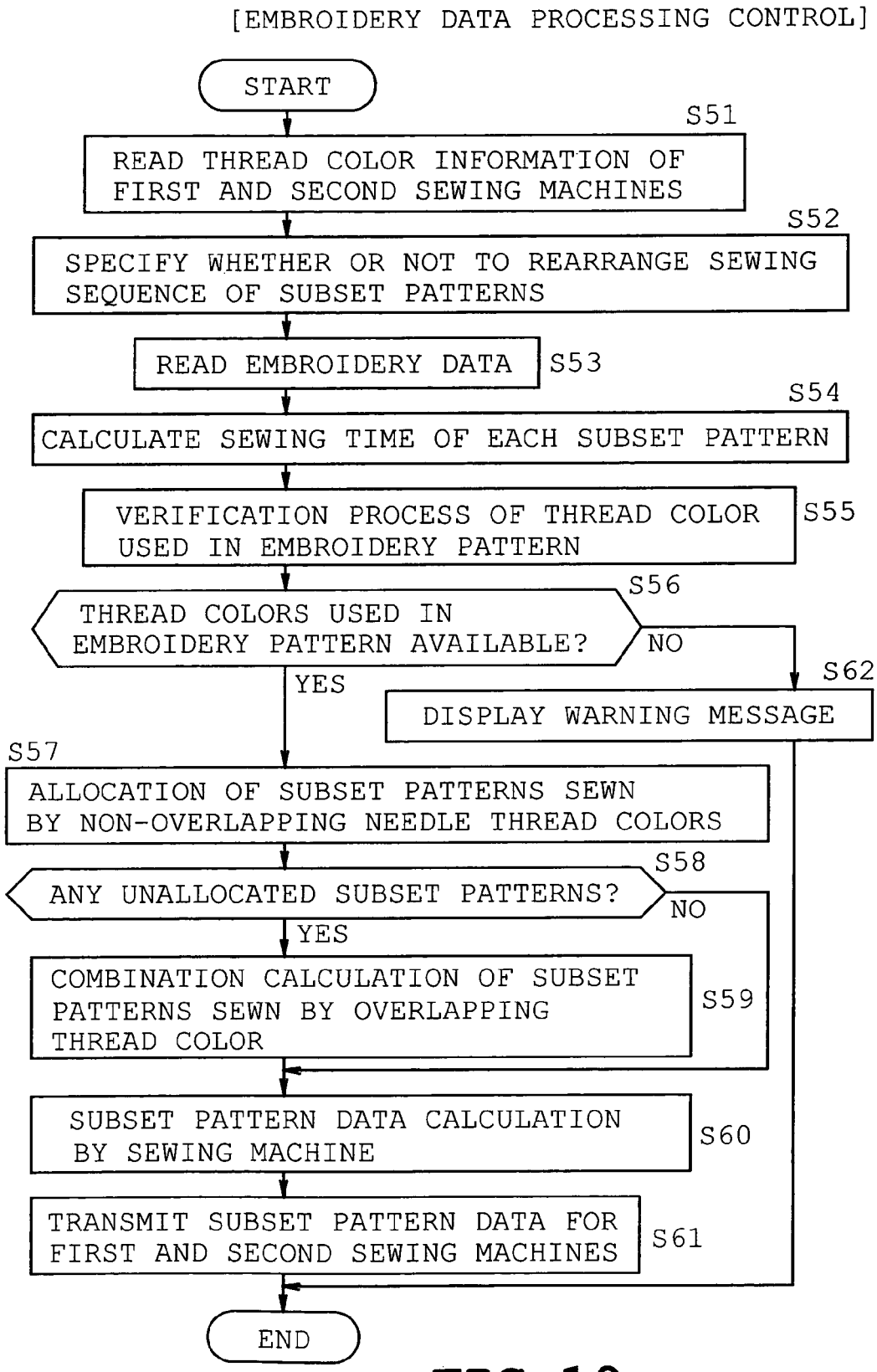
FIG. 19 is a flowchart describing a control flow of the second illustrative aspect that corresponds to FIG. 6.

Transceiver 54 is capable of independently transceiving various data to and from sewing controller 20A and 20B provided at first and second sewing machines M1A and M2A, respectively. ROM 51 stores various programs such as a start-up program for starting PC controller 41 when turning on the power of PC controller 41. Hard disc 53*a* stores an operating system (OS) and various drivers for components such as display 42, keyboard 43 and mouse 44. Hard disc 53*a* stores control program (refer to FIG. 19) of a later described embroidery data processing control.

A description will be given hereinafter on the embroidery data processing control (refer to FIG. 19) executed by PC controller 41. Steps S51 to S60 and S62 of the embroidery data processing control is identical to steps S11 to S20, and S22 of the embroidery data processing control indicated in FIG. 6 of the first exemplary embodiment. Thus, description will only be given on S61 which is the only difference. The following description will be based on an assumption that the embroidery data has been read into PC controller 41 from sewing machine M1A via interconnect 16A.

At S60, subset embroidery data to be sewn by first and second sewing machines M1A and M2A is calculated. Thus, if no rearrangement needs to be made, embroidery data illustrated in FIG. 14A (or FIG. 16A) for first sewing machine M1A and embroidery data illustrated in FIG. 14B (or FIG. 16B) for second sewing machine M2A is generated.

Embroidery data processor 40 transmits embroidery data shown in FIG. 14A (or FIG. 16A) for first sewing machine M1A to sewing controller 20A through transceiver 54. Embroidery data processor 40 further transmits embroidery data shown in FIG. 14B (or FIG. 16B) for second sewing machine M2A to sewing controller 20B through transceiver 54 (S61).

Based on the incoming embroidery data for first sewing machine M1A from embroidery data controller 40, first sewing machine M1A sews first to sixth subset patterns (or first to fourth subset patterns and sixth) at once on the workpiece cloth set on embroidery frame 9A.

Then, embroidery frame 9A is removed from first sewing machine M1A and attached to second sewing machine M2A. Then, based on the incoming embroidery data from embroidery data controller 40 for second sewing machine M2A, second sewing machine M2A sews the remaining seventh to tenth subset patterns (or fifth subset pattern and seventh to tenth subset patterns) at once on the workpiece cloth set to embroidery frame 9A.

The embroidery data processing control program stored in ROM 22A or hard disc 53*a* of first sewing machine M1A may be stored in various computer readable medium such as CD-ROMs, flexible disks, DVDs, and memory cards. In such case, by executing the programs stored in the medium read with various multi-needle embroidery sewing machines and embroidery data processors, the operation and effects obtained in the first exemplary embodiment can be obtained.

Partial modifications of the above described exemplary embodiments will be described hereinafter.

Embroidery sewing system HS1 may be configured by a single multi-needle embroidery sewing machine serving as a parent machine and three or more multi-needle embroidery sewing machine serving as child sewing machines that are connected to first sewing machine M1 through interconnect. Further, each multi-needle embroidery sewing machine may be configured so that needle threads of seven or more colors are replaceably arranged.

Embroidery sewing system HS2 may be configured by a single embroidery data processor and three or more multi-needle embroidery sewing machines serving as child sewing machines that are connected to the embroidery data processor through interconnect. Further, each multi-needle embroidery sewing machine may be configured so that needle threads of seven or more colors are replaceably arranged.

Embroidery data may also be stored in external medium such as CD-ROM, flexible disk, DVD, memory card, and USB memory other than ROM 22A.

Sew time may be calculated by multiplying the total number of stitches of each subset pattern by time expended on a single iteration of a standard sewing cycle.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data processor that processes embroidery data for sewing an embroidery pattern comprising a plurality of subset patterns on a workpiece cloth with different needle thread colors by using a plurality of multi-needle embroidery sewing machines each provided with an embroidery frame drive mechanism that moves an embroidery frame holding the workpiece cloth in two predetermined directions, the embroidery data processor, comprising:

a sew-time calculator that calculates required sew time for sewing each subset pattern based on subset pattern data being classified by thread color; and an allocator that produces an allocation schedule for allocation of the subset patterns to the multi-needle embroidery sewing machines based on the sew time calculated by the sew-time calculator, the allocation schedule being arranged to distribute equal or minimally-different sew time for each multi-needle embroidery sewing machine.

2. The processor of claim 1, wherein count of thread colors contained in the embroidery data is greater than count of needle thread colors available per single multi-needle embroidery sewing machine.

3. The processor of claim 1, wherein the allocator includes a combination calculator that calculates, when overlap occurs in the needle thread colors set to the multi-needle embroidery sewing machines, a plurality of combinations between the subset patterns sewn by the overlapping needle thread colors and the multi-needle embroidery sewing machines, and a machine-wise sew-time calculator that calculates the sew-time at each multi-needle sewing machine for each calculated combination.

4. The data processor of claim 3, wherein the allocator includes a selector that allows selection of whether or not to rearrange the sewing sequence of the subset patterns, and a sewing sequence modifier that allows modification of the sewing sequence of the subset patterns for at least one of the multi-needle embroidery sewing machines based on the calculation of the machine-wise sew-time calculator when selected to rearrange the sewing sequence by the selector.

5. The data processor of claim 1, further comprising a feed data modifier that modifies feed data for transferring the embroidery frame from an end location of previously sewn subset pattern data to a start location of subsequently sewn subset pattern data, and an end code relocator that relocates an end code for terminating embroidery pattern sewing.

6. An embroidery sewing system including an embroidery data processor that processes embroidery data for sewing an embroidery pattern comprising a plurality of subset patterns on a workpiece cloth with different needle thread colors by using a plurality of multi-needle embroidery sewing machines each provided with an embroidery frame drive mechanism that moves an embroidery frame holding the workpiece cloth in two predetermined directions, a first multi-needle embroidery sewing machine having a communication element capable of communicating data processed by the embroidery data processor to external components, and a second multi-needle embroidery sewing machine having a receiving element capable of receiving data transmitted by the first multi-needle embroidery sewing machine, the embroidery data processor comprising:

a sew-time calculator that calculates required sew time for sewing each subset pattern based on subset pattern data being classified by thread color; and an allocator that produces an allocation schedule for allocation of the subset patterns to the first and the second multi-needle embroidery sewing machines based on the sew time calculated by the sew-time calculator, the allocation schedule being arranged to distribute equal or minimally-different sew time for the first and the second multi-needle embroidery sewing machines.

7. An embroidery sewing system including an embroidery data processor that processes embroidery data for sewing an embroidery pattern comprising a plurality of subset patterns on a workpiece cloth, the embroidery data processor having a communicating element capable of communicating various processed data to external components, first and second multi-needle embroidery sewing machines each having a receiving element capable of receiving data transmitted by the embroidery data processor, the embroidery data processor comprising:

a sew-time calculator that calculates required sew time for sewing each subset pattern based on subset pattern data being classified by thread color; and an allocator that produces an allocation schedule for allocation of the subset patterns to the first and the second multi-needle embroidery sewing machines based on the sew time calculated by the sew-time calculator, the allocation schedule being arranged to distribute equal or minimally-different sew time for the first and the second multi-needle embroidery sewing machines.

8. A non-transitory computer readable medium storing an embroidery data processing program for use as an embroidery data processor that processes embroidery data for sewing an embroidery pattern comprising a plurality of subset patterns on a workpiece cloth with different needle thread colors by using a plurality of multi-needle embroidery sewing machines each provided with an embroidery frame drive mechanism that moves an embroidery frame holding the workpiece cloth in two predetermined directions, the embroidery data processing program stored in the computer readable medium, comprising:

instructions for calculating required sew time for sewing each subset pattern based on subset pattern data being classified by thread color; and instructions for producing an allocation schedule for allocation of the subset patterns to the multi-needle embroidery sewing machines based on the sew time calculated, the allocation schedule being arranged to distribute equal or minimally-different sew time for each multi-needle embroidery sewing machine.

9. The medium of claim 8, wherein count of thread colors contained in the embroidery data is greater than count of needle thread colors available per single multi-needle embroidery sewing machine.

10. The medium of claim 8, wherein the instructions for producing allocation schedule includes instructions for calculating a plurality of combinations between the subset patterns sewn by the overlapping needle thread colors and the multi-needle embroidery sewing machines when overlap occurs in the needle thread colors set to the multi-needle embroidery sewing machines, and instructions for calculating the sew-time at each multi-needle embroidery sewing machine for each calculated combination.

11. The medium of claim 10, wherein the instructions for producing allocation schedule includes instructions for selecting whether or not to rearrange the sewing sequence of the subset patterns, and instructions for modifying the sewing sequence of the subset patterns for at least one of the multi-needle embroidery sewing machines based on the calculated sew time at each multi-needle embroidery sewing machine when selected to rearrange the sewing sequence.

12. The medium of claim 8, further comprising instructions for modifying feed data for transferring the embroidery frame from an end location of previously sewn subset pattern data to a start location of subsequently sewn subset pattern data and instructions for relocating an end code for terminating embroidery pattern sewing.

13. A multi-needle embroidery sewing machine that processes embroidery data for sewing an embroidery pattern comprising a plurality of subset patterns on a workpiece cloth with different needle thread colors in cooperation with one or more external multi-needle embroidery sewing machine and being provided with an embroidery frame drive mechanism that moves an embroidery frame holding the workpiece cloth in two predetermined directions, the multi-needle embroidery sewing machine, comprising:

a sew-time calculator that calculates required sew time for sewing each subset pattern based on subset pattern data being classified by thread color; and an allocator that produces an allocation schedule for allocation of the subset patterns to the multi-needle embroidery sewing machine itself and the external multi-needle embroidery sewing machine based on the sew time calculated by the sew-time calculator, the allocation schedule being arranged to distribute equal or minimally-different sew time for the multi-needle embroidery sewing machine itself and the external multi-needle embroidery sewing machine.

14. The sewing machine of claim 13, wherein count of thread colors contained in the embroidery data is greater than count of needle thread colors available by the multi-needle embroidery sewing machine itself and the external multi-needle embroidery sewing machine.

15. The sewing machine of claim 13, wherein the allocator includes a combination calculator that calculates, when overlap occurs in the needle thread colors set to the multi-needle embroidery sewing machine itself and the external multi-needle embroidery sewing machine, a plurality of combinations between the subset patterns sewn by the overlapping needle thread colors and the multi-needle embroidery sewing machine itself and the external multi-needle embroidery sewing machine, and a machine-wise sew-time calculator that calculates the sew-time at the multi-needle embroidery sewing machine itself and the external multi-needle embroidery sewing machine for each calculated combination.

16. The sewing machine of claim 15, wherein the allocator includes a selector that allows selection of whether or not to rearrange the sewing sequence of the subset patterns, and a sewing sequence modifier that allows modification of the sewing sequence of the subset patterns for the multi-needle embroidery sewing machine itself and at least one of the external multi-needle sewing machines based on the calculation of the machine-wise sew-time calculator when selected to rearrange the sewing sequence by the selector.

17. The sewing machine of claim 13, further comprising a feed data modifier that modifies feed data for transferring the embroidery frame from an end location of previously sewn subset pattern data to a start location of subsequently sewn subset pattern data, and an end code relocator that relocates an end code for terminating embroidery pattern sewing.

* * * * *